United States Patent [19]

Muse

[11] Patent Number: 4,953,768

[45] Date of Patent: Sep. 4, 1990

[54] GOLF BAG RAIN COVER

[76] Inventor: Clarence W. Muse, 7613 Burgess St. W., Apt. D, Tacoma, Wash. 98467

[21] Appl. No.: 316,812

[22] Filed: Feb. 28, 1989

[51] Int. Cl.[5] ..... A45C 11/00

[52] U.S. Cl. ..... 224/205; 224/257; 150/159; 206/315.3; 206/315.7

[58] Field of Search ..... 150/159, 160; 206/315.3, 315.4, 315.7, 315.1; 224/202, 203, 205, 151, 257, 917; 248/96; 280/814, DIG. 5, DIG. 6

[56] References Cited

U.S. PATENT DOCUMENTS

| | | | |
|---|---|---|---|
| 1,636,194 | 7/1927 | Mullins | 224/205 |
| 2,718,251 | 9/1955 | Barbato | 150/159 |
| 2,747,637 | 5/1956 | Brown | 150/159 |
| 2,907,364 | 10/1959 | Trenery | 150/159 |
| 2,985,212 | 5/1961 | Dozier | 150/159 |
| 3,288,189 | 11/1966 | Davis | 150/159 |
| 3,316,951 | 5/1967 | Jacobson | 206/315.3 |
| 3,754,587 | 8/1973 | Rainieri | 150/159 |
| 4,474,388 | 10/1984 | Wagner | 280/646 |
| 4,657,135 | 4/1987 | Kjose | 248/96 |
| 4,778,136 | 10/1988 | Reimers | 248/96 |

FOREIGN PATENT DOCUMENTS

| | | | |
|---|---|---|---|
| 3229713 | 2/1984 | Fed. Rep. of Germany | 248/96 |

*Primary Examiner*—Henry J. Recla
*Assistant Examiner*—Glenn T. Barrett
*Attorney, Agent, or Firm*—Patrick Michael Dwyer

[57] ABSTRACT

Rain cover 20 encloses golf bag 11. Cover and bag are carried by shoulder strap 23 by way of upper loop 25 and lower loop 24. Lower loop 24 serves to retract legs 12 of bag 11 in the carrying position and upper loop 25 serves to connect shoulder strap 23 to connecting means 26. Connecting means 26 permits the removable attachment of cover 20 to bag 11 so that bag 11 cannot slip out of cover 20 while it is being carried.

12 Claims, 2 Drawing Sheets

GOLF BAG RAIN COVER

TECHNICAL FIELD

This invention relates to the field of water repellent covers for sporting equipment and more particularly to a rain cover for a golf bag.

BACKGROUND OF INVENTION

The need for a transparent, flexible, compact, lightweight, foldable, waterproof cover for a golf bag for use when the golfer is actually out on the course during inclement weather is well recognized, as for instance in U.S. Pat. No. 3,754,587 to Rainieri, Aug. 28, 1987; U.S. Pat. No. 2,985,212 to Dozier, Aug. 13, 1958; U.S. Pat. No. 3,316,951 to Jacobson, Apr. 26, 1965; U.S. Pat. No. 3,288,189 to Davis, Aug. 5, 1964; and U.S. Pat. No. 2,718,251 to Barbato, Mar. 15, 1954.

All of the above references disclose a transparent waterproof cover for a golf bag, each disclosure providing for covers with varying degrees of ease of access to clubs within the golf bag inside the cover, and with varying degrees of ease of installation and removal of the cover from the golf bag. None of the known covers provide a shoulder strap which is integral to the cover; instead, all known covers provide slits or sleeves in the cover for passing therethrough a shoulder strap of the golf bag itself. Consequently, the golf bag strap remains exposed to the weather, and, at least to some extent, the golf bag is exposed to moisture entering the cover through these slits or sleeves.

Accordingly, it is an object of the invention to provide a golf bag having integral thereto a shoulder strap so that the golf bag's shoulder strap can remain inside the cover and unused during inclement weather.

Jacobson's cover has handles 80 which are directly affixed to the panels of the cover and might be used as an independent carrying means. However neither Jacobson nor any other known covers provide a connecting means to attach an inside portion of the cover to the upper portion of the golf bag together with a shoulder strap attached at its upper end to that connecting means. Without such a provision, it would not be possible to carry a golf bag by means of a handle attached only to the cover without also requiring that the cover be closed at the bottom, as Jacobson suggests. Even then, a carrying means such as Jacobson discloses attached to a closed bottom cover places an undue strain upon the cover fabric. A golf bag within an open bottom cover having handles, but not having a means of attaching the cover to the golf bag would fall out of the cover when the cover was lifted by those handles. No known covers contain such a connecting means and a shoulder strap and none appear readily adaptable to contain such provisions.

Accordingly it is a further object of the invention to provide a connecting means integral to the cover to removably attach the inside of the cover to an upper portion of a golf bag.

None of the known covers are adapted to be used with the popular "Eclipse" type bag from Sun Mountain Sports, 235 North 1st St., Missoula, Montana 59802, U.S.A. The Eclipse type bag has two spring loaded extendable legs integral to the bag which normally extend under the influence of the force of integral elastic cords, so that when the bag is set down it automatically stands upright on its own tripod which consists of the bag itself and the two extended legs. The bag's own shoulder strap is attached at its lower end to a yoke which in turn attaches to each of the extendable legs through sleeves located at either side of the bag. Lifting on the shoulder strap of the golf bag retracts the legs for carrying. However, no known golf bag cover is designed to fit such a bag having integrally attached retractable legs, and no known cover is designed to retract these legs by lifting on the cover's own shoulder strap. The owner of an Eclipse bag must either use a very short rain cover so that the legs are free to extend, no cover at all, or forego the tripod effect when the bag is covered because when the bag is within a rain cover and the shoulder strap of the bag is not accessible, there is no means for conveniently retracting the legs. Accordingly it is an object of the invention to provide a rain cover for an Eclipse type bag which will retract the legs of the bag when the bag is lifted and carried by the shoulder strap of the cover, and which will then allow the legs to extend when the bag bottom is set on the ground.

DISCLOSURE OF THE INVENTION

The above objects of the invention as well as others which will become apparent herein are accomplished by the means and in the manner hereinafter set forth.

The golf bag rain cover of the invention is made of a waterproof, transparent or translucent plastic film which is preferably a four mil polyethylene for a combination of pliability, durability, and visibility of the golf bag and golf clubs inside the cover. However other materials may be made to serve as well within the scope of the invention, even at a sacrifice of any or all of the above three criteria. It is contemplated that the invention may be incorporated into any of a number of existing designs of golf bag rain covers including those enumerated in the above cited patent references. It has so far proved suitable to lay out a pattern for a rain cover upon a sheet of the desired plastic film and to cut out the rain cover in substantially a single piece. However a cover according to the invention may be manufactured from any number of pieces. The seams of the cover are preferably created by conventional stitching with stitch lengths no less than 1/16 of an inch to lessen the likelihood of a tear in the plastic film caused by a closer spacing of the needle holes. A conventional home type sewing machine employing conventional garment thread has proved adequate to assemble the rain cover of the invention. All straps, loops, and webbings further described below are made from common industrial woven webbing in one and two inch widths. A white nylon webbing of approximately a 400 pound strength has been found suitable for the invention.

The pattern or patterns chosen for assembling the rain cover will of course depend upon the desired shape of the cover, and means and methods for determining and laying out an appropriate pattern will be obvious to those skilled in the art. The preferred shape of the rain cover is generally cylindrical or otherwise in substantial conformance to the shape of the bag on which the cover is to be employed. The rain cover is loose fitting enough to easily and quickly slide over a golf bag at the onset of inclement weather conditions and to then be quickly and easily removed when the cover is no longer needed. In this regard a cover with an open bottom is preferred because of the greater ease of slipping the cover on and off of the bag thereby. However embodiments employing a closed bottom and having, instead of an open bottom, some other means to place the bag inside the cover will nonetheless lie within the scope of the invention. Each type of cover within the scope of the invention will have a length and width suitable to the bag with which the cover is intended for use. Generally the rain cover will be at least as long as a bag containing a set of clubs therein. However covers of shorter length are contemplated which will nonetheless fall within the scope of the invention.

The rain cover will have at least one opening for golf clubs, with other openings optional such as for access to various golf bag pockets. Any or all of the openings on the golf bag may be combined with closures of any well known type such as hook and pile and/or zippers. Alternatively a conventional overlapping type structure may be employed in openings, especially the opening for the golf clubs, to facilitate weatherproofing the golf bag from the elements as much as possible during access to the golf bag while the cover is in place.

A rain cover has a shoulder strap on a strapside of the cover, and preferred embodiments of the rain cover have a closeable opening on the backside of the cover, generally opposite the shoulder strap. This backside opening will generally run from the open end of the bottom of the cover to a point generally near a midpoint of the cover between the top and bottom of the cover. A shoulder strap is preferably padded. Strips of "pile" of the type generally employed with hook and pile type closures have been found to be suitable for both padding ability and durability, and are to be preferred over exposed kinds of foam rubber which can be rather quickly abraded and shredded by friction of the strap against the shoulder. However other types of padding arrangements will occur to those skilled in the art without departing from the scope of the invention.

For purposes of defining locations upon the cover, the side of the cover on which the shoulder strap lies is the strapside and the opposite side of the cover is the backside. Both strapside and backside will have midlines generally determined by the plane which is defined by the shoulder strap when the cover containing a bag is suspended from the shoulder by the shoulder strap as that plane passes through the cover. Each cover will also have a centerline generally defined by the axis of the more or less cylindrical shape of the cover when it is in use around the bag. The terms "upper" or "top" will refer to locations on the cover above a midpoint on this centerline, and "bottom" or "lower" will refer to locations below this centerline midpoint.

Each rain cover has at least one connecting means to removably attach a portion of the inside of the cover to the golf bag it covers. This connecting means may employ any of a number of structures, such as those more fully disclosed below. The purpose of the connecting means is to attach the golf bag to the cover so that the bag cannot slide out of the cover when the cover is lifted by the shoulder strap. In some embodiments, the connecting means will also serve to transfer the weight of the golf bag to the shoulder strap directly as is more fully disclosed below. The connecting means is generally intended to engage the standard hand strap, sometimes called the singlehand strap, of the golf bag. However connecting means are also contemplated which are intended to engage other structural aspects of the golf bag, such as rings, snaps, or other straps firmly attached to the golf bag. Preferably in use the cover is first slipped on over the golf bag and then the connecting means is accessed through the golf club opening of the cover and the connecting means is then manipulated and attached to the appropriate structural portion of the golf bag through this golf club opening of the cover.

As most golf bags have a vertically oriented hand strap, or loop, on the golf bag, a preferred connecting means consists of a single piece of webbing terminating on one end in a conventional gated snap link, and on the other end in a conventional D-ring. This inner webbing is attached across the upper strapside midline of the cover, on the inside of the cover, at one or more locations in such a way that the two ends of the webbing with the gated strap and the D-ring are free to be placed through the vertically oriented strap or loop on the golf bag and connected to each other therethrough. Other structures for the connecting means are contemplated however such as, where alternate golf bag attaching points exist such as the above enumerated rings, straps, etcetera, a single gated snap attached to the upper strapside midline of the inside of the cover, either directly to the cover, or at the end of a piece of webbing, the other end of which is attached to the inside of the cover. In this alternate structure, the gated snap is simply attached to the ring or horizontally oriented strap of the golf bag to accomplish the connection. Similarly, where horizontally oriented, or substantially horizontally oriented straps appear on a golf bag, a piece of webbing such as that described above, with a gated snap on one end and a D-ring on the other, may be employed, except that it is oriented substantially along the strapside midline of the cover instead of across the midline. It is also possible to employ two or more pieces of webbing or other equivalent material with any of a range of conventional releasable connecting link pairs, such as the gated snap/D-ring combination, wherein each such piece of webbing terminates in such a link and the other end is affixed to the inside of the cover.

In a preferred embodiment this inner webbing is attached to the cover by stitching, preferably by button hole type stitching for greater strength, but other fastening means may be employed such as riveting or grommeting without departing from the scope of the invention. In preferred embodiments where stitching is employed the single piece inner webbing is attached across the upper strapside midline of the inside of the cover by one or more pairs of stitch lines across the width of the webbing each stitch line of each pair of stitchlines spaced substantially equidistantly from the strapside midline of the cover. Ordinarily, one such pair of stitch lines has proved to be adequate and at a spacing of approximately 1 inch on either side of the midline.

It is to this connecting means that the shoulder strap is attached at its upper end, either directly or indirectly, through the cover material itself. In its simplest form a plain webbing shoulder strap is simply stitched directly through the cover to the inner webbing so that shoulder strap and inner webbing become thereby a single structure for transferring the weight of the golf bag to the shoulder strap while transferring little or no weight from the golf bag to the plastic film of the cover itself. As in the attachment of the inner webbing to the inside of the cover, various fastening means may be employed to attach the upper end of the shoulder strap to the inner webbing through the cover in this simplest embodiment.

In a preferred embodiment, an indirect means of attaching the upper end of the shoulder strap to the connecting means is employed A pair of D-rings are attached, directly or indirectly, to the inner webbing, through the cover, from the outside of the cover, in such a way that an upper loop, which engages the upper end of the shoulder strap, passes through this pair of D-rings and around an upper portion of the cover, with the upper end of the shoulder strap engaging this upper loop in such a way that the upper end of the shoulder strap engages a portion of the upper loop which is between the two D-rings. The two D-rings are spaced from the strapside midline of the cover at such a distance that when the shoulder strap is weight bearing (as when the cover contains a bag) a portion of the weight of the golf bag is conveyed through the inner webbing, through each of the D-rings, and thus to the upper loop. Generally the spacing of these D-rings is less than that of the width of the cover when laid flat. A preferred spacing is in the range of 4–6 inches apart and equidistant from the strapside midline of the cover. Additionally in this regard it should be noted that in order to best achieve this weight transfer effect of the bag through the D-rings to the upper loop it will be necessary to assure that the cover is of sufficient dimension and is large enough in circumference that when a golf bag is suspended by the connecting means, the distance by which it depends from the connecting means does not permit the bag to transfer any of its weight to the cover material itself independently from the transfer of the weight of the bag to the connecting means. This is generally provided for by making the lengths of the members of the connecting means as short as practical, consistent with achieving the connecting purpose of the linkage of the two ends of the inner webbing through the golf bag hand strap or the like.

The pair of D-rings through which runs the upper loop may, as suggested above, be either directly or indirectly attached to the connecting means through the cover. In one embodiment two D-rings are simply stitched through the plastic cover to the inner webbing at the appropriate spacing. In a preferred embodiment however, an outer webbing is employed which has two ends each of which terminates in a D-ring. Again as discussed above, it is not necessary that this outer webbing be a single piece of webbing, but it is preferably so. This outer webbing is stitched through the cover to the inner webbing as was suggested for the preferred method of stitching the inner webbing to the cover in the discussion of the connecting means above, except that in this preferred embodiment, the inner webbing and outer webbing are stitched to one another through the cover in the same operation to save time and material.

It is not necessary that the outer webbing have a length, and be stitched to the inner webbing, in such a way that the ends of the outer webbing are free of the cover material, but in a preferred embodiment the outer webbing is long enough and the stitching locations are placed such that between 2 and 3 inches at each end of the outer webbing depend freely between the nearest stitching point and the D-ring, to permit maintenance of the cover and bag at the proper carrying attitude (center of balance).

The upper loop may be directly stitched or otherwise fastened as above to the upper end of the shoulder strap, but in a preferred embodiment the upper end of the shoulder strap terminates in an upper strap loop through which the upper loop is free to run. This upper strap loop, and also a lower strap loop as is more fully disclosed below, are fashioned in a conventional manner by merely folding back a portion of the shoulder strap and stitching it to itself to form the strap loop. However other loop or ring type structures will serve as well at the ends of the shoulder strap. In addition, and with suitable tensile strength thread and density of stitching, the outer webbing and inner webbing may be fastened together through the cover along a single line across the width of the respective webbing along the strapside midline of the cover; however a paired spacing of stitching lines is preferred for equalization of potential stress and ease of construction. In a preferred embodiment the upper loop is further attached to the cover within the backside midline seam of the cover.

In an alternate arrangement of the above described attaching and carrying means, the dimension of the upper loop is short enough and the dimension of the connecting means inner webbing is long enough so that the upper loop actually functions as the primary weight bearing means of transferring weight of the bag to the shoulder strap. In this alternate arrangement, the connecting means then serves primarily to assure that the golf bag does not slide out of the bottom of the cover, or where the cover has a closed end, that the weight of the bag does not have to be born by the material at the bottom of the cover, whenever the bag is initially picked up or set down in a substantially vertical attitude as opposed to the substantially horizontal attitude in which it is carried in the loop.

The golf bag rain cover of the invention is also encircled about a lower portion of the cover by a lower loop, and the lower end of the shoulder strap is either attached directly to this lower loop or engages the lower loop in a manner similar to that described for the upper loop disclosed above. In a preferred embodiment the lower end of the shoulder strap terminates in a lower strap loop through which the lower loop is free to run. The lower loop is guided around the lower portion of the cover in a preferred embodiment either by a D-ring attached to the lower backside midline seam of the cover, or by a sleeve which is integral to the backside of the cover and runs substantially circumferentially across the backside of the cover as is more fully disclosed below. Unlike the upper loop disclosed above, the lower loop is always a weight bearing member and the weight of the lower portion of the covered golf bag is supported in the lower loop with the weight transferred through the loop to the lower end of the shoulder strap.

A preferred embodiment of the rain cover is designed to cover and cooperate with an Eclipse type golf bag such that when the Eclipse bag is standing on its tripod arrangement of extended legs, this lower loop encircles both the covered bag and the extended legs, crossing them at a point substantially below their point of attachment to the bag. Thus when the bag with its attached cover is carried on the shoulder of the golfer, the spring loaded Eclipse bag legs are held retracted against the bag and cover, but when the golfer sets the bag down on its base and thereby releases the tension in the lower loop, the spring loaded bag legs extend under the influence of the bag's integral elastic chords to expand the loop, extend the legs, and allow the bag to stand upright on its self-contained tripod support. In this particular embodiment, the shape of the cover is modified somewhat by the incorporation of a backside flared skirt which is cut and designed to accommodate the fully extended legs of the Eclipse type bag. The lower hem of this flared skirt contains the circumferential sleeve referred to above to guide the lower loop around the backside of the cover. This sleeve and hem of the flared skirt are fashioned in a well known manner. As a further variation in this particular embodiment, the lower portion of the backside of the cover below the flared skirt is split so that the cover may be slipped over the top of an Eclipse bag while it is standing on its legs, with the flared skirt partially covering the extended legs, and the split is then closed around the bottom portion of the bag with hook and pile fasteners. The cover, shoulder strap, and lower loop arrangement thus make it possible to effectively employ an Eclipse type bag with tripod legs fully operative, while at the same time completely covering the bag, including the bag's own shoulder strap, thereby protecting it from inclement weather conditions.

An alternate embodiment of the invention employs not a flared skirt as disclosed above, but a closeable split opening running substantially along the backside midline from the bottom of the bag to or beyond the midpoint of that midline. This embodiment will serve for use both with a conventional bag alone and with a conventional bag to which is attached an external bag stand, whether or not that external stand has its own wheels. In this embodiment the lower loop encircles the lower portion of the cover and is guided across the backside by a D-ring fastened to the backside of the cover as described above. This cover is placed upon a bag, to which is attached an external bag stand, by opening the backside split, and then slipping the cover over the bag and stand in such a way that the loop passes around the outside of the bag stand framework and encircles it along with the bag. The split opening is then closed around the lower portion of the bag, either by hook and pile closures or by conventional zipper, from the bottom upwardly nearly to the top of the opening leaving only enough space at the top of the opening for the structural member of the stand which connects the stand to the bag to pass through. The external bag stand legs or wheels thus remain outside of the cover, but when the shoulder strap of the cover is lifted both the bag and the stand are thereby carried.

In either of the above embodiments the lower loop may either be in the form of a loop of webbing running through the lower strap loop at the lower end of the shoulder strap or may alternatively be directly attached, such as by stitching, to the lower end of the shoulder strap to form a yoke of webbing passing around either side of the lower portion of the cover.

BEST MODE FOR CARRYING OUT THE INVENTION

Figure 1:
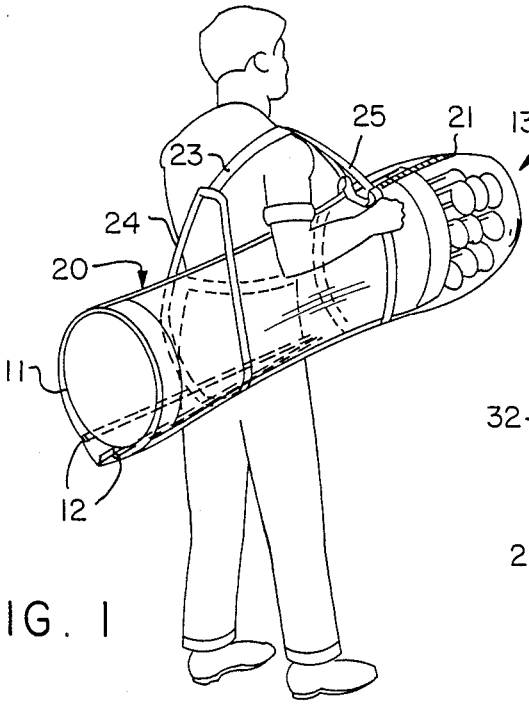
FIG. 1 is an isometric view of the invention with golf bag being carried upon the shoulder of a golfer.
Figure 2:
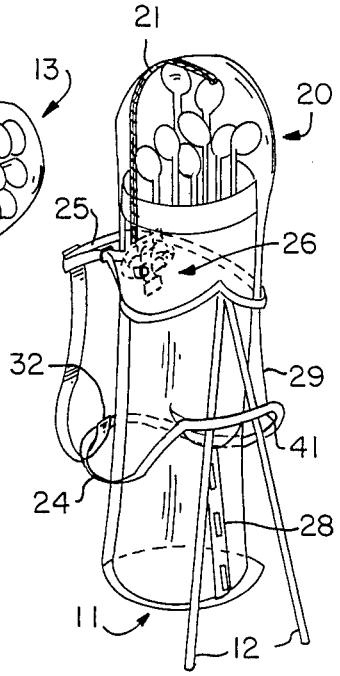
FIG. 2 is an isometric of the invention in place upon a golf bag having extendable legs.

Referring now to the drawings wherein like numbers indicate like parts the invention is particularly described. In FIG. 1 rain cover 20 encloses golf bag 11. Golf bag 11 contains a set of clubs 13 which are accessible through cover 20 by club access 21. Cover and bag are supported by upper loop 25 and lower loop 24 across the golfer's shoulder by shoulder strap 23. FIG. 2 depicts cover 20 disposed over an Eclipse type golf bag 11 having extendable legs 12. A portion of extendable legs 12 is covered by flared skirt 29 and a lower portion of bag 11 and legs 12 as well as cover 20 are encircled by lower loop 24. Lower loop 24 passes through lower strap loop 32 and is slideably engaged therein. Lower loop 24 is guided through sleeve 41 around the backside of cover 20 at the hem of flared skirt 29. The lower portion of bag 11 is covered by backside opening 28. Backside opening 28 is closeable with closures 27.

Figure 3:
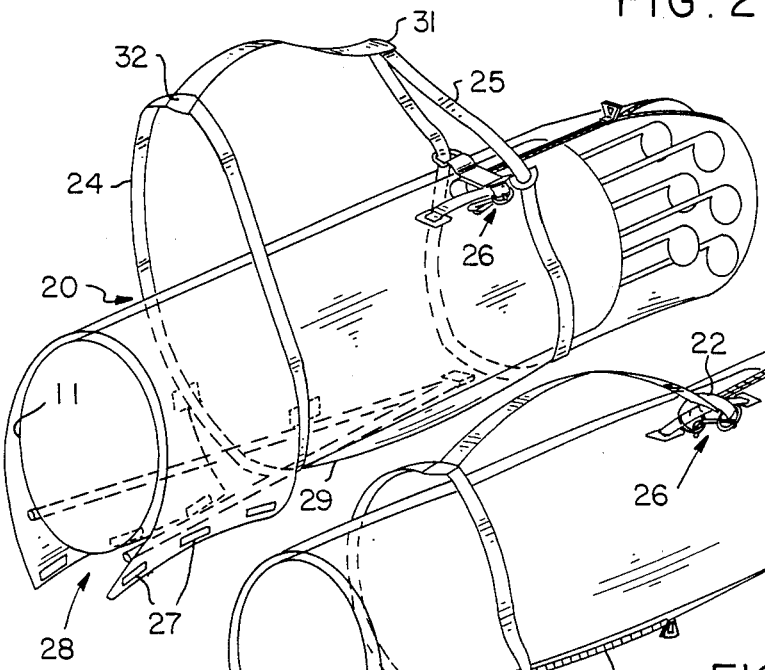
FIG. 3 is an isometric of the apparatus of FIG. 2 shown in carrying position.

In FIG. 3 cover 20 and bag 11 of FIG. 2 are shown in carrying position suspended between upper loop 25 and lower loop 24 upon shoulder strap 23. Lower loop 24 has caused the retraction of legs 12 and flared skirt 29. Backside opening 28 is shown opened for convenience of illustration; however in carrying position backside opening 28 would normally be closed by closures 27. Shoulder strap 23 terminates at its upper end in upper strap loop 31 in which upper loop 25 is slideably engaged. Shoulder strap 23 is connected via upper loop 25 to connecting means 26.

Figure 4:
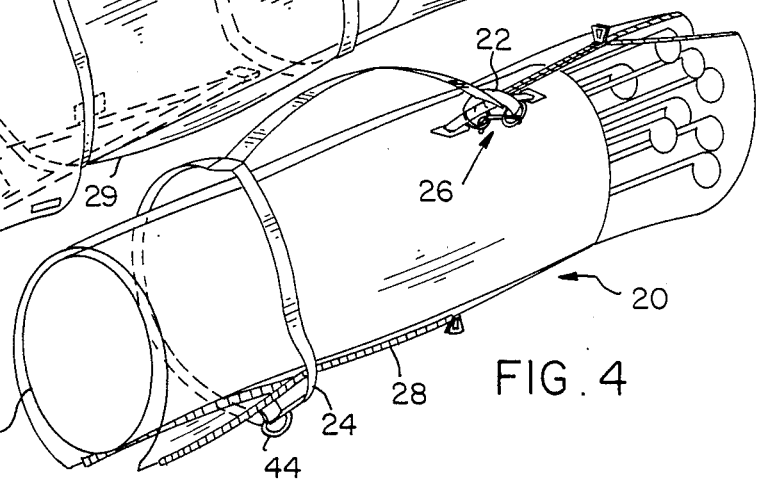
FIG. 4 is an alternate embodiment of the apparatus of FIG. 3.
Figure 6:
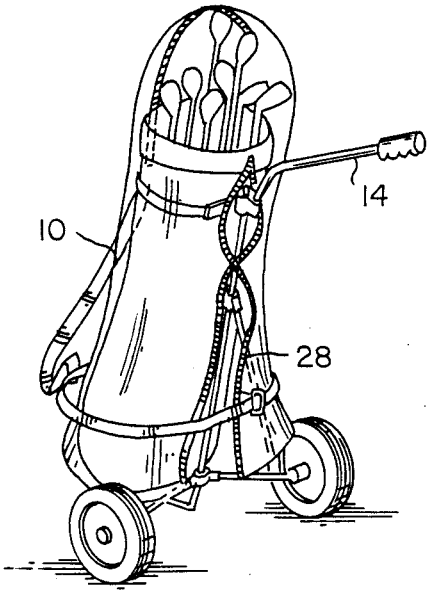
FIG. 6 is a isometric of the alternate apparatus of figure 4 displayed upon a bag to which is attached an external stand.
Figure 5:
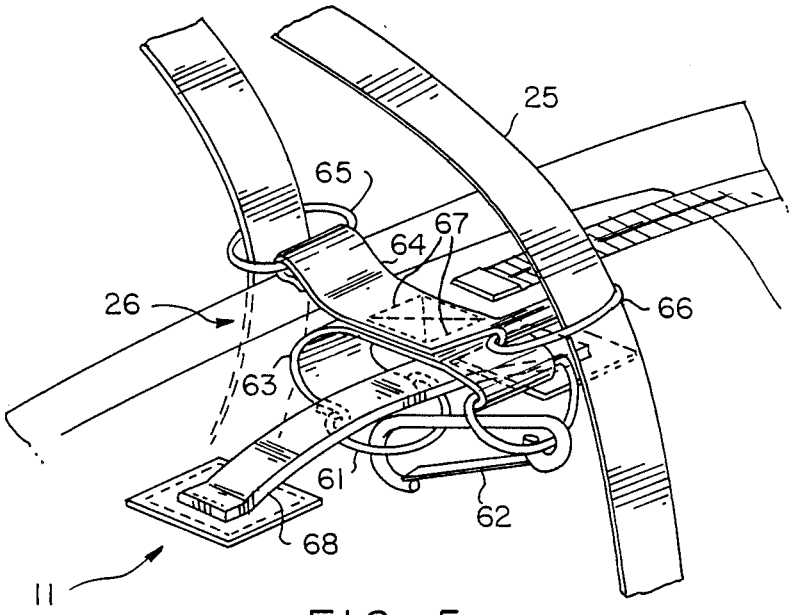
FIG. 5 is a detail from FIG. 3 taken generally at 26.

In FIG. 5 connecting means 26 is shown enlarged for greater detail. Bag 11 has attached hand strap 68 along an upper portion of the bag and generally vertically disposed thereon through which the two webs of inner webbing 63 terminating in D-ring 61 and gated snap 62 are threaded and linked. Inner webbing 63 is stitched through cover 20 to outer webbing 64 along stitch lines 67 such that two ends of outer webbing 64 are free of cover 20 and terminate in D-rings 65 and 66 through which passes upper loop 25. Lifting on shoulder strap 23 causes tension in upper loop 25 and transfer of the upper weight of bag 11 through upper loop 25 to shoulder strap 23. A portion of that weight is also transferred through D-rings 65 and 66 to outer webbing 64 which causes a tension through outer webbing 64 and a general tightening up or tension in connecting means 26 to snug connecting means 26 to hand strap 68 and thus prevent sliding of bag 11 within cover 20 during the pick up and set down operation In FIG. 4 is shown an alternate embodiment of cover 20 having a lower loop 24 which passes through, at the backside of cover 20, a D-ring 44. Also depicted is alternate connecting means 26' which does not employ an outer webbing 64 or an upper loop 25. Instead shoulder strap 23 is attached directly at its upper end through cover 20 to inner webbing 63. In this embodiment the weight of the upper portion of bag 10 is transferred through connecting means 26' directly to shoulder strap 23. In FIG. 6 the apparatus in FIG. 4 is shown in standing position upon bag 10 with bag 10 having attached thereto an external bag stand 14. Back opening 28 is shown opened up to the handle of external stand 14.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

This invention will find use in the sporting good industry particularly in the sale of accessories to golfers the world over. Although many different rain covers presently exist, none permit so easy and complete and inexpensive a covering of a golf bag as the present invention. The invention allows covering of any golf bag, including the golf bag shoulder strap which is not used because of the rain cover's own shoulder strap. The rain cover is particularly well adapted to the popular Eclipse type golf bag from Sun Mountain Sports and permits the complete coverage of the Sun Mountain bag while still taking advantage of that bag's retractable leg feature.

I claim:

1. A golf bag rain cover comprising: a cover member surrounding a golf bag, a connecting means to removably attach a portion of an inside of said cover member to said golf bag; and a shoulder strap attached at an upper end of said strap to said connecting means; wherein said connecting means comprises an inner webbing affixed to said inside of said cover member, on a strapside portion of said cover member, above a midpoint of a centerline of said cover member, said inner webbing terminating in two ends releasably connectable to each other.

2. The rain cover of claim 1 wherein said shoulder strap is attached to said inner webbing by fastening means passing through said upper end of said shoulder strap, said cover member and said inner webbing.

3. The rain cover of claim 2 wherein said inner webbing has two ends having a O-ring and a gated snap connecting said ends together, and said fastening means comprises stitching.

4. The rain cover of claim 1, in combination with a golf bag, wherein said inner webbing has two ends, said ends being connected together through a loop of a conventional handstrap located on an upper portion of said bag.

5. The rain cover of claim 1 further comprising:

a pair of D-rings attached to said inner webbing, said D-rings located on an outside of said cover member and spaced on either side of a strapside midline of said cover member; and an upper loop intermediate between said upper end of said shoulder strap and said connecting means;

wherein said upper loop encircles an upper portion of said cover member while running through said pair of D-rings.

6. The rain cover of claim 5 further comprising an outer webbing terminating at two ends having a D-ring attached to each end wherein said D-rings are attached to said inner webbing by fastening said outer webbing through said cover member to said inner webbing.

7. The rain cover of claim 6 wherein said outer webbing is lesser in length than said cover's width, and said outer webbing is attached to said inner webbing at one or more pairs of attachment locations along said outer webbing, each location in each said pair of locations spaced substantially equidistantly from the other on either side of said strapside midline.

8. The rain cover of claim 7 wherein the number of said pairs of attachment locations along said outer webbing is one, and said pair of locations is selected such that a substantial length of said outer webbing runs between each D-ring and its proximate attachment location.

9. The rain cover of claim 5 wherein said upper loop is slideably engaged in an upper strap loop in said upper end of said shoulder strap.

10. The rain cover of claim 1 wherein said shoulder strap terminates at a lower end in a lower loop, said lower loop encircling a lower portion of said cover.

11. The rain cover of claim 10 wherein said cover member runs substantially the full length of a golf bag, said length including the length of a set of golf clubs within said bag.

12. In combination, a golf bag having two or more spring loaded extendable legs, and a golf bag rain cover, said rain cover comprising a cover member surrounding a golf bag, a connecting means to removably attach a portion of an inside of said cover member to a golf bag, and a shoulder strap attached at an upper end of said strap to said connecting means, said shoulder strap terminating at a lower end in a lower loop, said lower loop encircling a lower portion of said bag and said extendable legs such that, whenever said connecting means attaches said cover to said bag, lifting said cover and bag combination by said shoulder strap causes said legs to retract.

* * * * *

UNITED STATES PATENT AND TRADEMARK OFFICE

CERTIFICATE OF CORRECTION

PATENT NO. : 4, 953, 768

DATED : September 4, 1990

INVENTOR(S) : Clarence W. Muse

It is certified that error appears in the above—identified patent and that said Letters Patent is hereby corrected as shown below:

At column 9, line 34, "O-ring" should be changed to --D-ring--.

Signed and Sealed this

Seventh Day of January, 1992

*Attest:*

HARRY F. MANBECK, JR.

*Attesting Officer*

*Commissioner of Patents and Trademarks*